US011678778B1

(12) United States Patent
Jin

(10) Patent No.: US 11,678,778 B1
(45) Date of Patent: Jun. 20, 2023

(54) TOILETING DEVICE FOR CHILDREN

(71) Applicant: Yuzhao Jin, Taizhou (CN)

(72) Inventor: Yuzhao Jin, Taizhou (CN)

( * ) Notice: Subject to any disclaimer, the term of this patent is extended or adjusted under 35 U.S.C. 154(b) by 0 days.

(21) Appl. No.: 17/885,415

(22) Filed: Aug. 10, 2022

(51) Int. Cl.
*A47K 13/06* (2006.01)

(52) U.S. Cl.
CPC ..... *A47K 13/06* (2013.01)

(58) Field of Classification Search
CPC ..... A47D 1/00–006; A47D 1/023; A47D 1/10–103; A47K 13/005; A47K 13/06; A47K 17/026; A47K 17/028
See application file for complete search history.

(56) References Cited

U.S. PATENT DOCUMENTS 4,777,672 A * 10/1988 Gebhard ..... A47K 11/04 297/130
D310,869 S * 9/1990 Sedlack ..... D6/372
4,958,885 A * 9/1990 Kassai ..... A47D 1/023 297/55
5,755,489 A * 5/1998 Rossman ..... A47C 4/02 297/440.16
5,809,584 A * 9/1998 Potts ..... G09B 19/0076 4/239
6,598,240 B1 * 7/2003 Chang ..... A47K 13/06 4/235
6,698,036 B2 * 3/2004 Armbruster ..... A47K 13/06 4/483
D570,461 S * 6/2008 Desnos-Simon ..... D23/296
10,076,214 B2 * 9/2018 Goh Aow ..... A47K 11/06
2011/0138531 A1 * 6/2011 Sumpton ..... A47C 12/00 4/622

FOREIGN PATENT DOCUMENTS

DE 202007002625 * 7/2007 ..... A47K 13/06
FR 3041519 * 3/2017 ..... A47K 13/06

* cited by examiner

*Primary Examiner* — David P Angwin
*Assistant Examiner* — Nicholas A Ros

(57) ABSTRACT

The present disclosure discloses a toileting device for children, including a seating part, supporting legs, and a bottom plate; each supporting leg includes a main rod and an auxiliary rod; an upper end of the main rod is connected to one end of the seating part, and a lower end is connected to one end of the bottom plate; and an upper end of the auxiliary rod is connected to the main rod, and a lower end is connected to the other end of the bottom plate.

14 Claims, 7 Drawing Sheets

TOILETING DEVICE FOR CHILDREN

CROSS-REFERENCE TO RELATED APPLICATIONS

The application claims priority of Chinese Utility Model application CN202221731387.4, filed on Jul. 4, 2022, which is incorporated herein by reference.

TECHNICAL FIELD

The present disclosure belongs to the field of sanitary products for children, and particularly relates to a toileting device for children.

BACKGROUND ART

Most of existing domestic toilets are generally designed in a size suitable for adults. Seats are too high and too large for children, which are not convenient for children to use. As a result, there are some toilets specially designed for children on the market, but the children's toilets need to be additionally connected to a sewage pipe or be manually dumped, which is troublesome in cleaning. The children's toilet takes up a large space, which is not suitable for small families.

However, a toileting device for children on the market has poor stability, that is, when a seat of the toileting device is placed on a toilet seat, the seat easily slides off from the toilet seat. There is a potential safety hazard.

SUMMARY

In order to overcome the disadvantage of the existing toileting device, the present disclosure provides toileting device for children.

The present disclosure adopts the following technical solution: a toileting device for children including a seating part, supporting legs, and a bottom plate, the seating part used for being placed on a toilet seat for children to be seated; each supporting leg including a main rod and an auxiliary rod; an upper end of the main rod connected to one end of the seating part, and a lower end connected to one end of the bottom plate; an upper end of the auxiliary rod connected to the main rod, and a lower end connected to the other end of the bottom plate; the mutually connected main rods and auxiliary rods and the bottom plate forming a stable supporting structure.

Further, the toileting device for children includes a pedal which is connected to the supporting legs, the pedal is arranged between the bottom plate and the seating part, and is used for allowing children to tread and climb.

Further, each main rod is provided with a plug on one side; the upper end of the auxiliary rod is provided with a first mounting opening; and the first mounting opening is detachably connected with the plug.

Further, the toileting device for children includes a first fastening structure, the first fastening structure includes a fastener and a fastening slot; the fastener is arranged at the plug; the fastening slot is formed in the first mounting opening; and the fastener is fastened in the fastening slot to achieve detachable connection between the auxiliary rod and the plug.

Further, the bottom plate includes a first plate body and a second plate body; the first plate body is detachably connected to the second plate body; the lower ends of the main rods are connected to the first plate body, and the lower ends of the auxiliary rods are connected to the second plate body, so that a stable "triangular" structure is formed among the main rods, the auxiliary rods and the bottom plate.

Further, two second plate bodies are provided, which are respectively connected to left and right ends of the first plate body; and when the two plate bodies are respectively connected to the first plate body, a space is formed between the two second plate bodies.

Further, a connecting assembly is arranged between the first plate body and the second plate body, and includes an insertion slot and an insertion block which are respectively arranged on the first plate body and the second plate body; and the insertion block is sleeved in the insertion slot.

Further, the toileting device for children includes a second fastening structure, the second fastening structure includes a fastening slot arranged on an inner wall of the insertion slot, and an inverted fastener arranged on the insertion block; and when the insertion block is sleeved into the insertion slot, the inverted fastener is fastened in the fastening slot.

Further, each main rod has an adjustable length, and includes a first rod body and a second rod body; the second rod body is provided with a second mounting opening; and the first rod body is detachably connected to the second mounting opening.

Further, the plug is arranged on the second rod body.

Further, the toileting device for children includes a fastening piece, several adjusting holes are formed in the first rod body; the second mounting opening of the second rod body is provided with first connecting holes corresponding to the adjusting holes; and the fastening piece passes through the first connecting holes and the adjusting holes in sequence to achieve fixed connection between the first rod body and the second mounting opening.

Further, the adjusting holes are disposed along a vertical direction of the first rod body; and the first connecting holes are respectively connected to different adjusting holes through the fastening piece to achieve height adjustment of the main rod.

Further, left and right sides of the pedal are provided with sleeving holes sleeved on the main rod.

Further, second connecting holes are arranged on the sleeving holes; and the fastening piece passes through the second connecting holes, the first connecting holes and the adjusting holes in sequence to achieve connection of the first rod body, the second rod body and the pedal.

Further, a bottom of the seating part is provided with several suction disk portions used for being sucked on a toilet.

The present disclosure has the beneficial effects: by the arrangement of the above structure, the auxiliary rod, the second rod body and the bottom plate form a relatively stable triangular structure. The supporting stability of the entire bottom plate is improved by means of the triangular structure, so that the stability of use of the toileting device is improved, and the safety of children during use is improved.

BRIEF DESCRIPTION OF THE DRAWINGS

For the purpose of a clearer description of the embodiments in this application or technical solutions in prior art, below is a brief introduction of the attached drawings needed to be used in the description of the embodiments or prior art. Apparently, the attached drawings in the following description are only some embodiments indicated in the present application. For ordinary skill in the art, they may obtain other drawings according to these attached drawings without any innovative laboring.

The present disclosure will be further described with reference to the attached drawings and the embodiments hereunder.

DETAILED DESCRIPTION OF THE EMBODIMENTS

In order to provide a clear understanding of the objects, features, and advantages of the embodiments, the following are detailed and complete descriptions to the technological solutions adopted in the embodiments. Obviously, the descriptions are part of the whole embodiments. The other embodiments which are not processed creatively by technicians of ordinary skills in the field are under the protection of this disclosure. The same is given with reference to the drawings and specific embodiments. It should be noted that non-conflicting embodiments in the disclosure and the features in the embodiments may be combined with each other without conflict.

In the following description, numerous specific details are set forth in order to provide a full understanding of the disclosure. The disclosure may be practiced otherwise than as described herein. The following specific embodiments are not to limit the scope of the disclosure.

Unless defined otherwise, all technical and scientific terms herein have the same meaning as used in the field of the art as generally understood. The terms used in the disclosure are to describe particular embodiments and are not intended to limit the disclosure.

The disclosure, referencing the accompanying drawings, is illustrated by way of examples and not by way of limitation. It should be noted that references to "an" or "one" embodiment in this disclosure are not necessarily to the same embodiment, and such references mean "at least one."

A toileting device for children includes a seating part 1, two supporting legs 2, a pedal 3 and a bottom plate 4.

Figure 1:
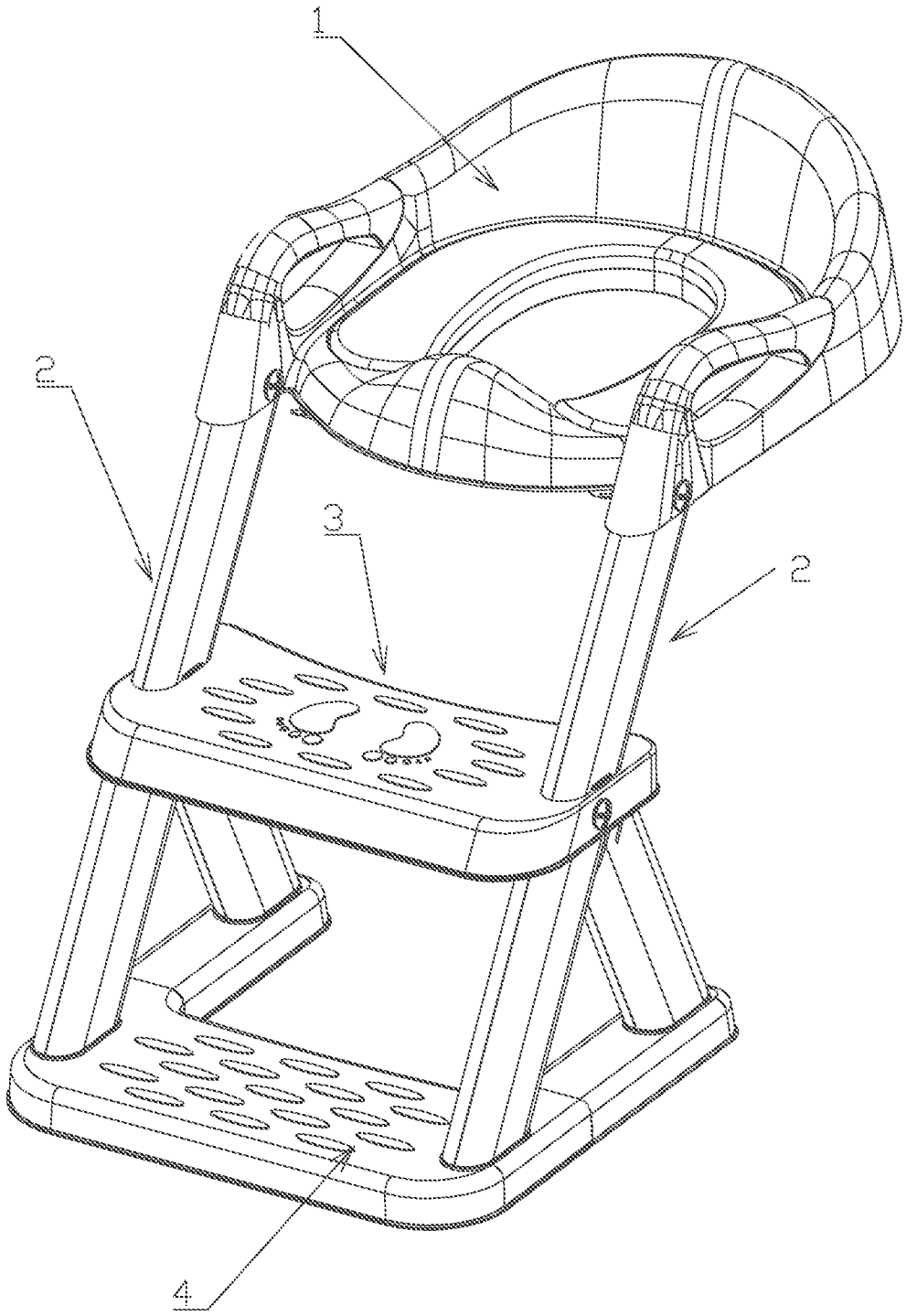
FIG. 1 is a schematic structural diagram of the present disclosure.
Figure 2:
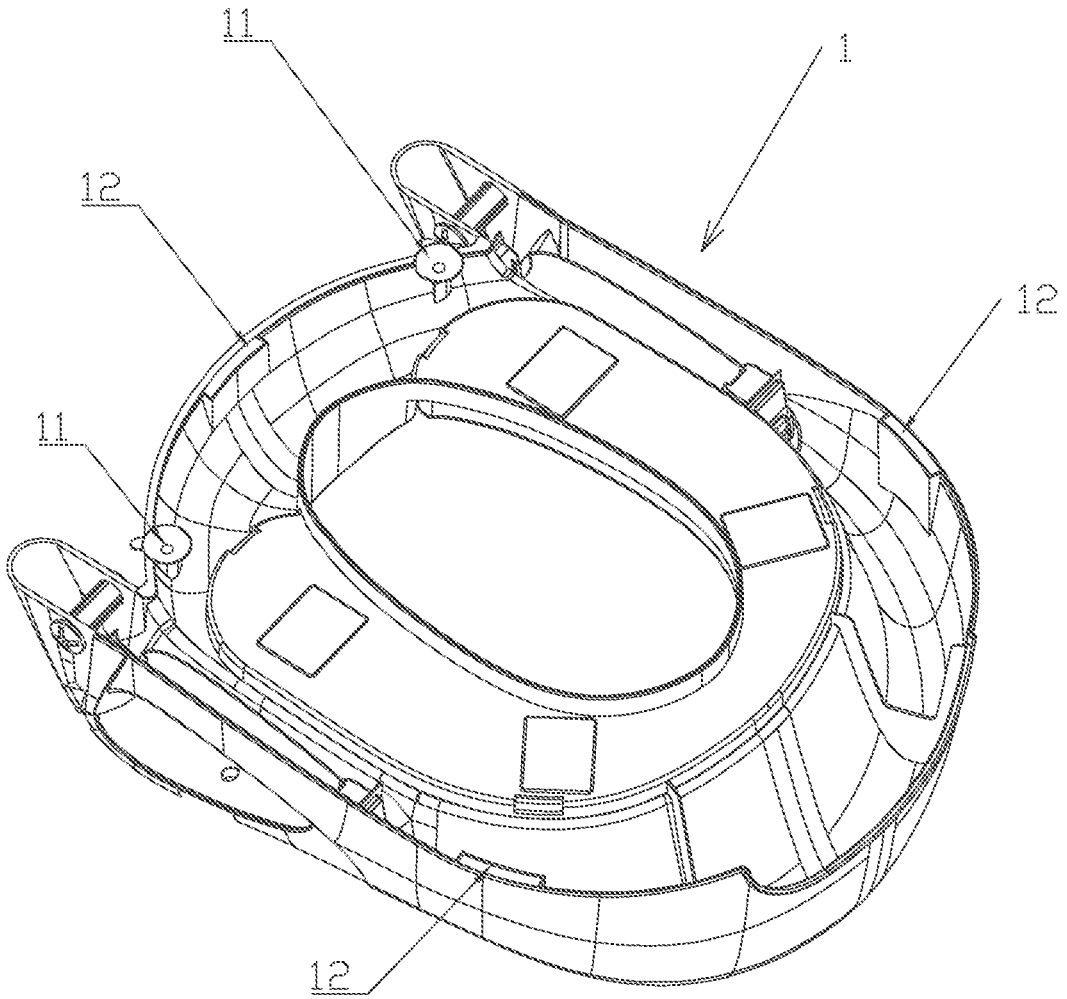
FIG. 2 is a schematic diagram of a back surface of a seating part.

The seating part 1 is overall ringlike, which is used for being placed on a toilet seat for children to be seated. As shown in FIGS. 1 and 2, in order to prevent the seating part 1 from sliding off from the toilet seat, a bottom of the seating part 1 is provided with several suction disk portions 11 which are sucked on the toilet seat or toilet ring to fix the seating part 1. In addition, the bottom of the seating part 1 is also provided with several antiskid pads 12 to increase friction between the seating part 1 and a toilet, so as to prevent the seating part 1 from sliding on the toilet seat and improve the safety of children during use.

The two supporting legs 2 are respectively connected to two sides of a front end of the seating part 1. The supporting legs 2 are used for supporting the seating part 1. That is, when the seating part 1 is placed on the toilet seat for back supporting, the supporting legs 2 are arranged at the front end of the seating part 1 for front supporting. The pedal 3 and the bottom plate 4 are arranged between the two supporting legs 2 up and down. The pedal 3 is used for allowing children to tread, and the bottom plate 4 is used for enlarging a contact area between the supporting legs 2 and the ground, thus improving the supporting stability of the supporting legs 2.

Figure 3:
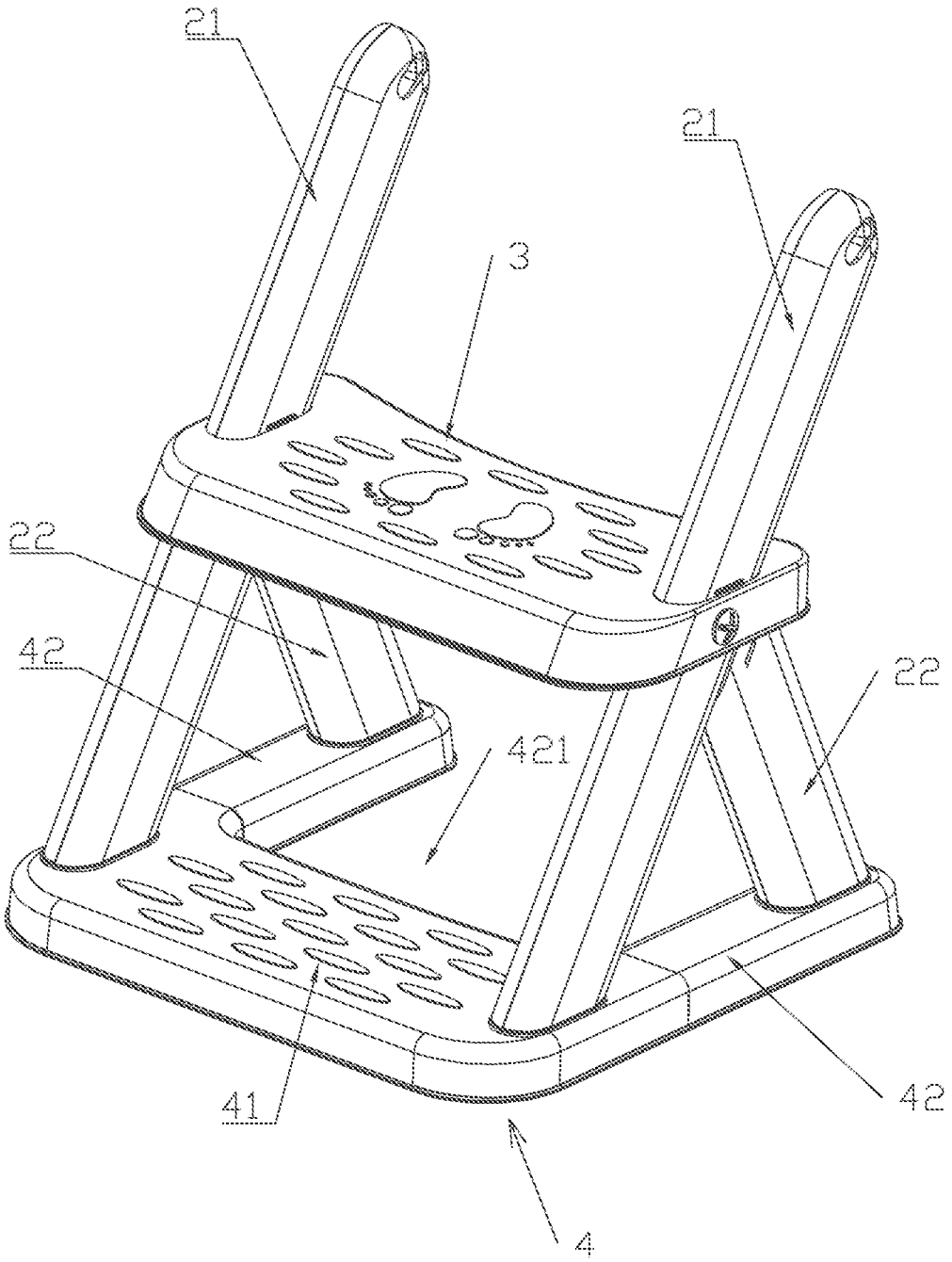
FIG. 3 is a schematic diagram of assembling of supporting legs, a pedal and a bottom plate.

Each supporting leg 2 includes a main rod 21 and an auxiliary rod 22; an upper end of the main rod 21 is connected to the front end of the seating part 1, and a lower end of the main rod 21 is connected to a front end of the bottom plate 4. As shown in FIGS. 1 and 3, when each main rod 21 is connected, the main rod 21 is skewed towards one side relative to a horizontal plane to adapt to a leg placement angle when children go to the toilet. An upper end of the auxiliary rod 22 is connected to one side of the main rod 21, and a lower end of the auxiliary rod 22 is connected to the other end of the bottom plate 4.

Figure 4:
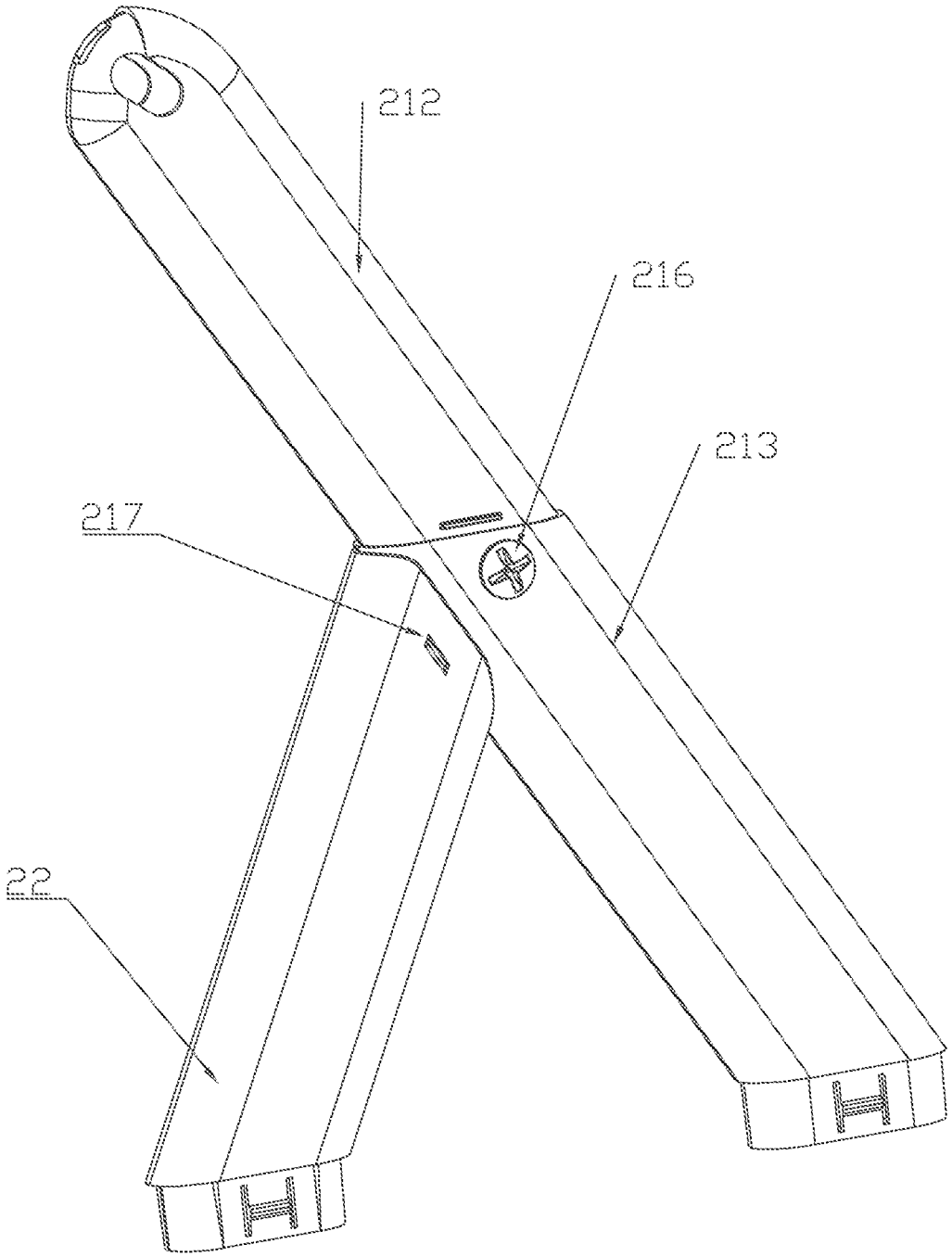
FIG. 4 is a schematic structural diagram of a supporting leg.
Figure 5:
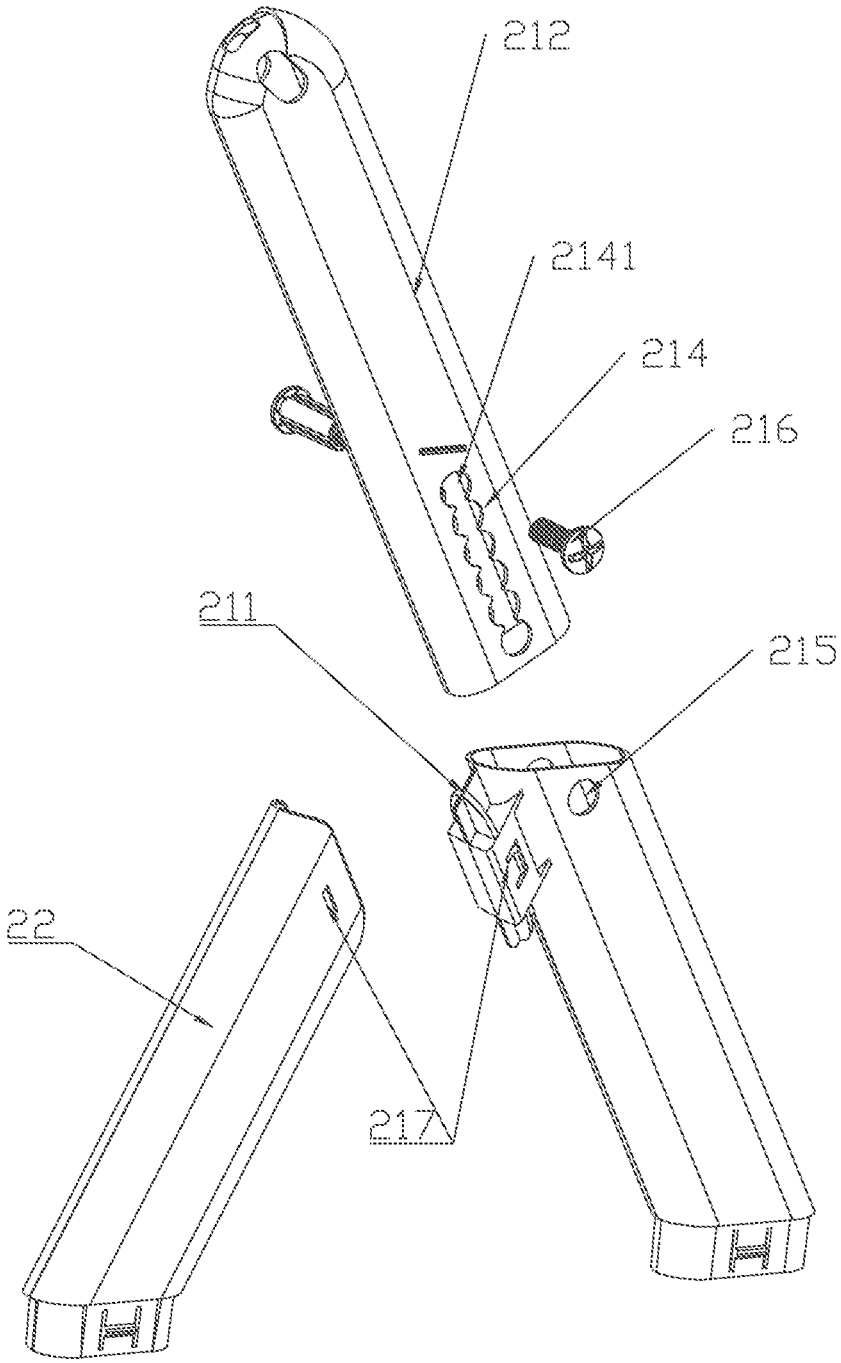
FIG. 5 is a schematic exploded diagram of a supporting leg.

Specifically as shown in FIGS. 4 and 5, the main rod 21 and the auxiliary rod 22 are both flat hollow pipe fittings. Hollowing can save materials to a certain extent, and the hollow pipe fittings can be quickly plugged for assembling. Specifically, the main rod 21 includes a first rod body 212 and a second rod body 213; an adjusting hole 214 is formed in the first rod body 212; a first connecting hole 215 corresponding to the adjusting hole 214 is formed in the second rod body 213; a fastening piece 216 for connecting the first rod body 212 to the second rod body 213 is arranged in a manner of passing through the first connecting hole 215 and the adjusting hole 214; and a relative position between the first rod body 212 and the second rod body 213 is adjusted by placing the fastening piece 216 in different hole positions of the adjusting hole 214.

As shown in FIG. 5, the adjusting hole 214 is formed in a side wall of the first rod body 212. The adjusting hole 214 is formed by connecting several round hole portions 2141 in sequence; the first connecting hole 215 is arranged on a side wall of the second rod body 213 and is opposite to the adjusting hole 214; and an aperture of the first connecting hole 215 is equivalent to that of the round hole portion 2141. When the first rod body 212 is plugged to the second rod body 213, a depth of the first rod body 212 plugged into the second rod body 213 can be adjusted to enable the first connecting hole 215 to be opposite to different round hole portions 2141 on the adjusting hole 214, thus adjusting a length of the main rod 21 formed after the first rod body 212 is plugged into the second rod body 213, and adjusting a height of the seating part 1. The fastening piece 216 is generally a screw assembly that passes through the first connecting hole 215 and the adjusting hole 214.

A plug 211 is arranged on one side of the main rod 21, and the auxiliary rod 22 is hollowed and is plugged on the plug 211. As shown in FIG. 5, in this embodiment, the plug 211 is integrally formed on one side of the second rod body 213 and faces a rear side of the main rod 21. The plug is specifically a bulge integrally formed on the second rod body 213 and matched with the aperture of the auxiliary rod 22. The auxiliary rod 22 can be directly fixed on the plug 211 in a plugged manner. When the lower end of the auxiliary rod 22 is connected to the other end of the bottom plate 4, the auxiliary rod 22, the second rod body 213 and the bottom plate 4 form a relatively stable triangular structure. The supporting stability of the entire bottom plate 4 is improved by means of the triangular structure, so that the stability of use of the toileting device is improved, and the safety of children during use is improved.

A first fastening structure 217 for fixing is arranged between the plug 211 and the auxiliary rod 22. As shown in FIG. 5, the first fastening structure 217 includes a fastener arranged on one side of the plug 211, and fastening slots located on two sides of the auxiliary rod 22. When the auxiliary rod 22 is plugged, the fastener is directly fastened in the fastening slots to achieve connection between the auxiliary rod 22 and the plug 211. The fastening slots are arranged on two sides of the auxiliary rod 22, so that it is not necessary to consider the front and back of the auxiliary rod 22 during plugging of the auxiliary rod 22, which accelerates the plugging of the auxiliary rod 22 to a certain extent.

It should be noted that the plug 211 and the auxiliary rod 22 can also be in fastening connection in an interference fit manner, or the plug 211 and the auxiliary rod 22 may not be provided with fastening structures. This is because the overall structure is stable after the auxiliary rod 22, the second rod body 213 and the bottom plate 4 are connected into the triangular structure. Their stable splicing can be achieved as long as the lengths of the auxiliary rod 22, the second rod body 213 and the bottom plate 4 are matched.

Figure 7:
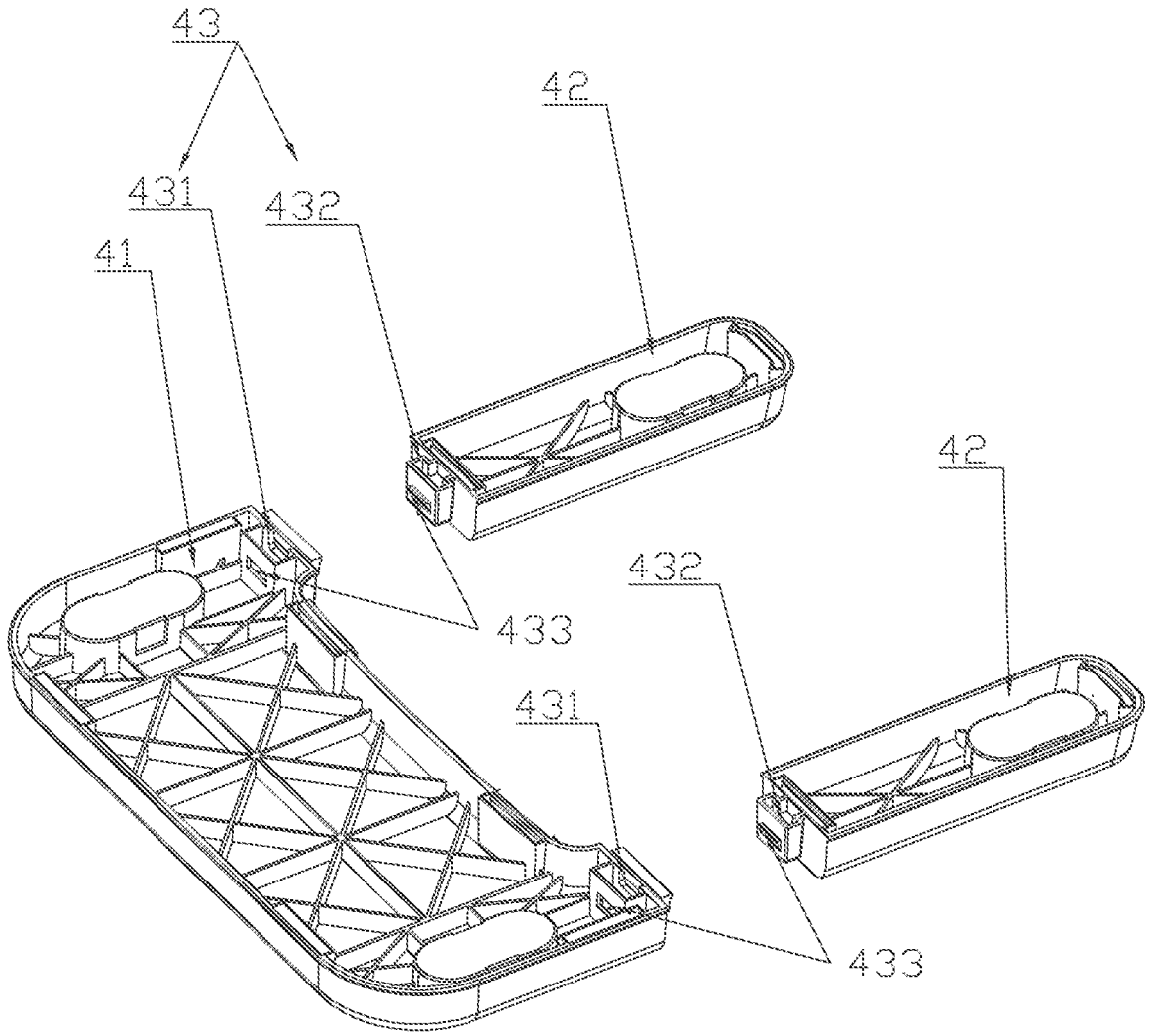
FIG. 7 is a schematic exploded diagram of a bottom plate.

The bottom plate 4 includes a first plate body 41 and a second plate body 42 which are detachably connected through a connecting assembly 43. The main rod 21 and the auxiliary rod 22 are respectively connected to the first plate body 41 and the second plate body 42. As shown in FIG. 7, the first plate body 41 is square. Left and right ends of the first plate body 41 are provided with plugging slots for connecting the main rod 21. Two strip-type second plate bodies 42 are provided. Plugging slots for connecting the auxiliary rod 22 are also formed in the second plate bodies 42. The first plate body 41 is used for allowing children to tread, so that children can climb to the seating part 1, so that the first plate body 41 is required to have a large volume. The second plate bodies 42 only need to provide a supporting space for the auxiliary rod 22, so that there are two plate bodies 42 respectively arranged at the left and right ends of the first plate body 41, thus forming a space 421 between the two second plate bodies 42 to save materials. Furthermore, if the first plate body 41 and the second plate bodies 42 are integrally formed, the second plate bodies 42 with small volumes will occupy a large packaging volume, so that the first plate body 41 and the second plate bodies 42 are split in this patent to reduce the packaging volume and reduce the packaging cost.

The connecting assembly 43 includes insertion slots 431 and insertion blocks 432 which are respectively arranged on the first plate body 41 and the second plate bodies 42. Second fastening structures 433 for connecting the first plate body to the second plate bodies when the insertion blocks 432 are located in the insertion slots 431 are arranged between the insertion slots 431 and the insertion blocks 432. Specifically as shown in FIG. 7, each insertion block 432 is fixed at an end portion of each second plate body 42 through a connecting pin, and the insertion slots 431 are formed in the bottom of the first plate body 41; and the second fastening structures 433 include fastening slots arranged on inner walls of the insertion slots 431 and inverted fasteners arranged on the insertion blocks 432. During connection, the insertion blocks 432 are inserted into the insertion slots 431 from bottom to top, and the insertion blocks and the insertion slots are connected by means of fastening the fastening slots and the inverted fasteners.

Figure 6:
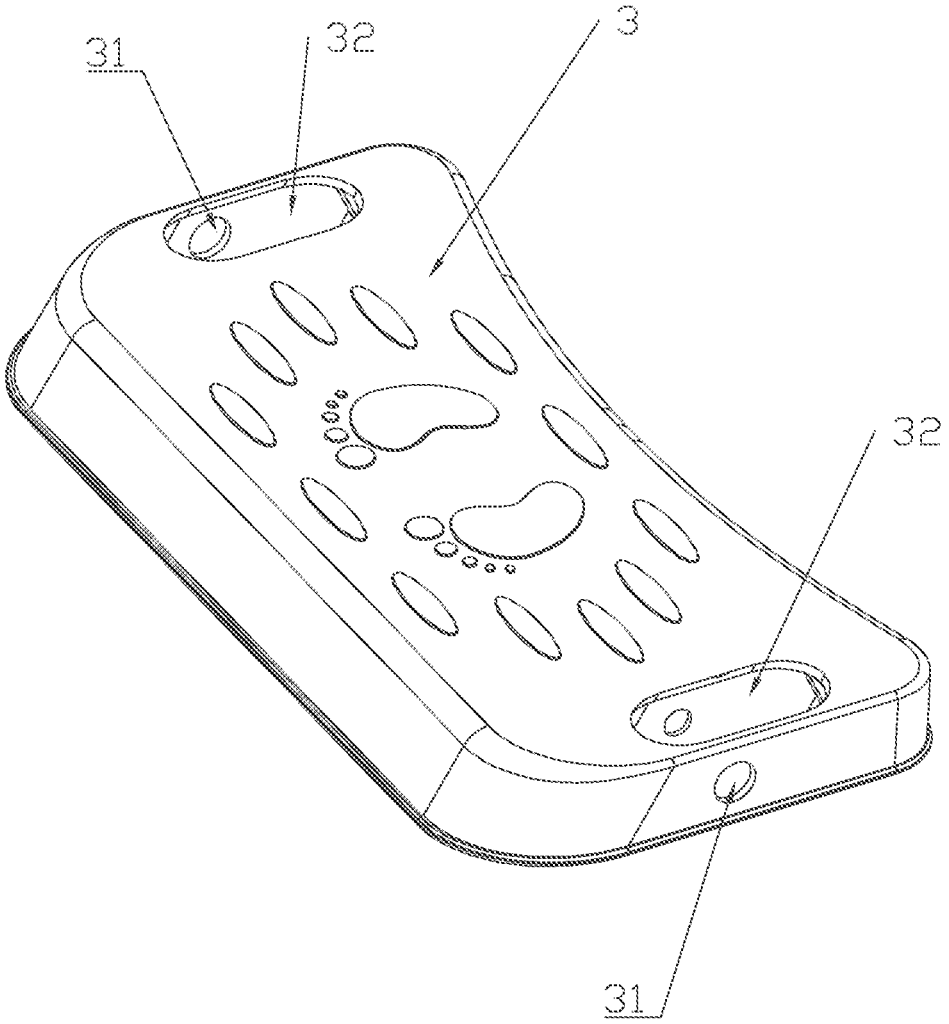
FIG. 6 is a schematic structural diagram of a pedal.

Second connecting holes 31 are formed in the pedal 3; the fastening piece 216 passes through the second connecting holes 31, the first connecting holes 215 and the adjusting holes 214 in sequence to connect the first rod body 212, the second rod body 213 and the pedal 3. As shown in FIG. 6, left and right sides of the pedal 3 are provided with sleeving holes 32 sleeved on the second rod body 213, and the left and right sides of the pedal 3 are provided with the second connecting holes 31 communicated to the sleeving holes 32. During connection, the pedal 3 is sleeved on the second rod bodies 213 through the sleeving holes 32 and is located at the plugs 211 of the second rod bodies 213, so that sleeved positioning of the pedal 3 is achieved through the plugs 211. At this time, the second connecting holes 31 are opposite to the first connecting holes 215 on the second rod bodies 213. A user can fix the pedal 3 in the supporting legs 2 by simultaneously threading the fastening pieces 216 through the first connecting holes 215, the second connecting holes 31 and the adjusting holes 214.

Finally, it should be noted that above embodiments are merely used for illustrating the technical solutions of the disclosure, rather than limiting the disclosure; though the disclosure is illustrated in detail with reference to the aforementioned embodiments, it should be understood by those of ordinary skill in the art that modifications may still be made on the technical solutions disclosed in the aforementioned respective embodiments, or equivalent substitutions may be made to a part of technical features thereof; and these modifications or substitutions do not make the essence of the corresponding technical solutions depart from the spirit and scope of the technical solutions of the respective embodiments of the disclosure.

What is claimed is:

1. A toileting device for children, comprising a seating part, supporting legs, and a bottom plate, wherein the seating part is used for being placed on a toilet seat for children to be seated; each supporting leg comprises a main rod and an auxiliary rod; an upper end of the main rod is connected to one end of the seating part, and a lower end is connected to one end of the bottom plate; an upper end of the auxiliary rod is connected to the main rod, and a lower end is connected to the other end of the bottom plate; the mutually connected main rods and auxiliary rods and the bottom plate form a stable supporting structure, wherein the bottom plate comprises a first plate body and a second plate body; the first plate body is detachably connected to the second plate body; the lower ends of the main rods are connected to the first plate body, and the lower ends of the auxiliary rods are connected to the second plate body, so that a stable triangular structure is formed among the main rods, the auxiliary rods and the bottom plate.

2. The toileting device for children according to claim 1, wherein a bottom of the seating part is provided with several suction disk portions used for being sucked on a toilet.

3. The toileting device for children according to claim 1, wherein two second plate bodies are provided, which are respectively connected to left and right ends of the first plate body; and when the two plate bodies are respectively connected to the first plate body, a space is formed between the two second plate bodies.

4. The toileting device for children according to claim 3, wherein a connecting assembly is arranged between the first plate body and the second plate body, and comprises an insertion slot and an insertion block which are respectively arranged on the first plate body and the second plate body; and the insertion block is sleeved in the insertion slot.

5. The toileting device for children according to claim 4, further comprising a second fastening structure, wherein the second fastening structure comprises a fastening slot arranged on an inner wall of the insertion slot, and an inverted fastener arranged on the insertion block; and when the insertion block is sleeved into the insertion slot, the inverted fastener is fastened in the fastening slot.

6. The toileting device for children according to claim 1, further comprising a pedal which is connected to the supporting legs, wherein the pedal is arranged between the bottom plate and the seating part, and is used for allowing children to tread and climb.

7. The toileting device for children according to claim 6, wherein each main rod is provided with a plug on one side; the upper end of the auxiliary rod is provided with a first mounting opening; and the first mounting opening is detachably connected with the plug.

8. The toileting device for children according to claim 7, further comprising a first fastening structure, wherein the first fastening structure comprises a fastener and a fastening slot; the fastener is arranged at the plug; the fastening slot is formed in the first mounting opening; and the fastener is fastened in the fastening slot to achieve detachable connection between the auxiliary rod and the plug.

9. The toileting device for children according to claim 7, wherein each main rod has an adjustable length, and comprises a first rod body and a second rod body; the second rod body is provided with a second mounting opening; and the first rod body is detachably connected to the second mounting opening.

10. The toileting device for children according to claim 9, wherein the plug is arranged on the second rod body.

11. The toileting device for children according to claim 10, further comprising a fastening piece, wherein several adjusting holes are formed in the first rod body; the second mounting opening of the second rod body is provided with first connecting holes corresponding to the adjusting holes; and the fastening piece passes through the first connecting holes and the adjusting holes in sequence to achieve fixed connection between the first rod body and the second mounting opening.

12. The toileting device for children according to claim 11, wherein the adjusting holes are disposed along a vertical direction of the first rod body; and the first connecting holes are respectively connected to different adjusting holes through the fastening piece to achieve height adjustment of the main rod.

13. The toileting device for children according to claim 12, wherein left and right sides of the pedal are provided with sleeving holes sleeved on the main rod.

14. The toileting device for children according to claim 13, wherein second connecting holes are arranged on the sleeving holes; and the fastening piece passes through the second connecting holes, the first connecting holes and the adjusting holes in sequence to achieve connection of the first rod body, the second rod body and the pedal.

* * * * *